US006892471B2

(12) United States Patent
Ragnarsson

(10) Patent No.: US 6,892,471 B2
(45) Date of Patent: May 17, 2005

(54) SLUDGE DRYER

(76) Inventor: Anders T. Ragnarsson, 22 Whittier St., Newton, NH (US) 03858

( * ) Notice: Subject to any disclaimer, the term of this patent is extended or adjusted under 35 U.S.C. 154(b) by 0 days.

(21) Appl. No.: 10/612,684

(22) Filed: Jul. 2, 2003

(65) Prior Publication Data

US 2005/0000108 A1 Jan. 6, 2005

(51) Int. Cl.[7] ..... F26B 13/30

(52) U.S. Cl. ..... 34/92; 34/108; 34/185; 432/112; 432/118

(58) Field of Search ..... 34/92, 108, 112, 34/119, 124, 185; 432/112, 118

(56) References Cited

U.S. PATENT DOCUMENTS

| | | | | |
|---|---|---|---|---|
| 144,358 | A | | 11/1873 | Root et al. |
| 3,214,352 | A | | 10/1965 | Wells |
| 3,826,718 | A | | 7/1974 | Takayasu |
| 3,859,052 | A | | 1/1975 | Walther |
| 3,997,406 | A | | 12/1976 | Arvanitakis |
| 4,109,019 | A | * | 8/1978 | Moore ..... 426/69 |
| 4,198,265 | A | | 4/1980 | Johnson |
| 4,296,072 | A | | 10/1981 | Takacs et al. |
| 5,028,298 | A | | 7/1991 | Baba et al. |
| 5,103,578 | A | | 4/1992 | Rickard |
| 5,137,604 | A | | 8/1992 | Meeks et al. |
| 5,245,762 | A | | 9/1993 | Hartis et al. |
| 5,325,605 | A | | 7/1994 | Carew |
| 5,531,866 | A | | 7/1996 | Pathak et al. |
| 5,545,296 | A | | 8/1996 | Pathak et al. |
| 5,575,894 | A | | 11/1996 | Foral |
| 5,580,426 | A | | 12/1996 | Ganeshan |
| 5,609,735 | A | | 3/1997 | Hetzel et al. |
| 5,669,419 | A | | 9/1997 | Haas |
| 5,733,417 | A | | 3/1998 | Foral |
| 5,871,619 | A | | 2/1999 | Finley et al. |

* cited by examiner

*Primary Examiner*—Jiping Lu
(74) *Attorney, Agent, or Firm*—Davis & Bujold, P.L.L.C.

(57) ABSTRACT

A material drying apparatus for substantially eliminating the liquid content of a sludge, the apparatus including a first stage operating at ambient pressure for heating the sludge; a second stage operating with partial vacuum for receiving heated sludge from the first stage for further heating and for drying the sludge by evaporation of substantially all liquid therefrom leaving a dry particulate material; and an evacuated cyclonic stage for applying sufficient centrifugal force to the dry particulate material to render this material odorless.

17 Claims, 3 Drawing Sheets

SLUDGE DRYER

FIELD OF THE INVENTION

This invention relates to an apparatus and method for drying sludge to produce a substantially dry benign end product e.g. for use as a fertilizer or an innocuous and biologically benign material which can be readily disposed of.

DEFINITION

Sludge as used herein shall be construed as including semi-solids, sludges and slurries, e.g. sewage, fecal material, containing evaporable liquids, particularly, though not exclusively, water.

BACKGROUND OF THE INVENTION

There are many methods of reducing the moisture content of sludges and slurries containing organic material including filtering using filter presses, heating or chemical treatment or applying partial vacuums. A major concern when using heat and a partial vacuum to dehydrate materials is the high temperature to which the material is heated while exposing the material to an optimum vacuum level. In addition the high temperatures involved tend to reduce or destroy the fertile quality of the end product. In addition, prior art proposals are often suited only to dehydration of batches of sludge as opposed to a continuous process suitable for the mass production of a benign particulate end product.

OBJECTS OF THE INVENTION

It is an object of the invention to provide apparatus for continuously drying sludges to provide an end product having fertile qualities.

It is an object of the invention to provide a continuous process to produce an environmentally benign particulate dry final product from sludge, e.g. sewage or fecal material.

It is yet a further object of the present invention to use a cyclonic action to produce substantially dry material which is substantially odorless.

STATEMENT OF THE INVENTION

According to the invention there is provided a material drying apparatus for continuous operation to substantially evaporate the liquid content of a sludge, the apparatus comprising:

a first stage operating at ambient pressure for heating the sludge;

a second stage operating with partial vacuum for receiving heated sludge from the first stage for further heating and for drying the sludge by evaporation of substantially all liquid therefrom to leave a dry particulate material; and a cyclonic stage operating with a partial vacuum for applying sufficient centrifugal force to the dry particulate material to render this material substantially odorless.

Preferably the first stage comprises a cylindrical housing defining a longitudinal axis, a hollow shaft coaxial with the housing and extending entirely through the housing, and conveyor paddles mounted on the hollow shaft and helically inclined relative to the axis to convey, upon rotation of the hollow shaft, sludge from an input end of the cylindrical housing to an outlet end thereof while being heated, wherein the paddles terminate at their radially outer ends sufficiently proximate the cylindrical housing to scrape sludge from the housing during rotation of the paddles about the axis by the hollow shaft and are mounted on the hollow shaft by tubes the interiors of which are open to the interior of the hollow shaft whereby steam introduced into the hollow shaft will enter the tubes to provide a heat source for the sludge.

A rotary transfer lock may be disposed between an outlet for the heated sludge from the first stage and the inlet for the heated sludge into the second stage, the transfer lock comprising a cylindrical chamber closed at its ends and housing a finned rotor having a plurality of fins cooperating with the cylindrical chamber to substantially prevent loss of the partial vacuum from the second stage while, upon rotation of the finned rotor, the heated sludge from the first stage is metered through the transfer lock for onward transmission to the second stage; and the finned rotor may be hollow and is provided with openings to allow air introduced into the rotor to pass into the heated sludge being metered through the transfer lock in order to prevent clogging of the finned rotor. The air maybe hot to one of further heat and maintain heat of the sludge.

A shredder disposed between the rotary transfer lock and the inlet for the heated sludge into the second stage is desirable, the shredder serving to break the heated sludge into small pieces and particles.

Also preferably the second stage comprises a cylindrical housing defining a longitudinal axis, a hollow shaft coaxial with said housing and a plurality of tined projections mounted on the shaft for rotation with the shaft to agitate particles and break up small pieces of the sludge entering the second stage, the tined projections terminating closely adjacent the housing with each projection having a plurality of tines and with the housing supporting blocks which cooperate with the tines upon rotation thereof to remove material from between the tines, and the tined projections may be mounted on the hollow shaft by tubes the interiors of which are open to the interior of the hollow shaft to receive steam passed through the hollow shaft to provide additional heating of the sludge.

Again preferably dried particulate material from the second stage is drawn into a cyclone by a vacuum pump connected to the cyclone to provide the partial vacuum in the cyclone and second stage, the material being drawn into the cyclone by way of a venturi to accelerate the particles for entry tangentially into the cyclone whereby centrifugal force generated by passage of the dried particles in the cyclone renders the dried particles substantially odorless, a rotary transfer lock being located to provide an outlet for particles from the cyclone and to substantially prevent loss of the partial vacuum from the second stage and the cyclone.

The invention also provides a method of drying sludge to produce a benign particulate material comprising the steps of:

a) heating the sludge at ambient pressure to a temperature of at least 200° F. while being continuously conveyed through a first stage of an apparatus;

b) heating and drying the previously heated sludge under a partial vacuum in a second stage of the apparatus;

c) substantially preventing loss of the partial vacuum from the second stage at a location between the first and second stages;

d) shredding the heated sludge to reduce the heated sludge to small pieces and particles prior to entry into the second stage;

e) agitating the small pieces and particles in the second stage to break up the small pieces therein; and f) subjecting the particles dried in the second stage to a centrifugal force sufficient to provide a substantially odorless particulate product.

BRIEF DESCRIPTION OF THE DRAWINGS

The invention will now be described, by way of example, with reference to the accompanying drawings, in which.

DETAILED DESCRIPTION OF THE INVENTION

Figure 1:
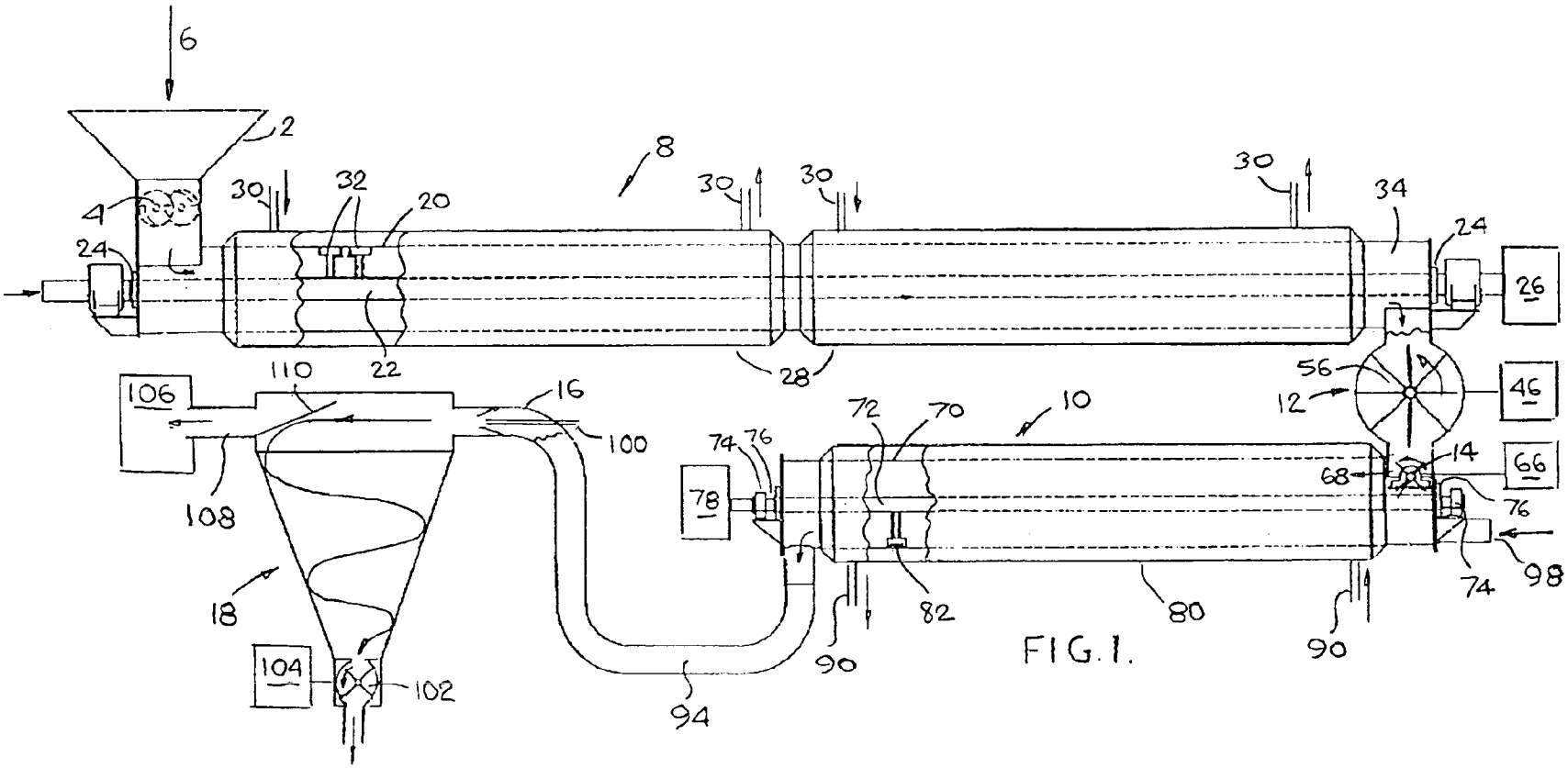
FIG. 1 is a diagrammatic partially sectioned view of apparatus according to the present invention.

Referring to FIG. 1, the sludge drying apparatus comprises: a supply hopper 2 which, by way of a rotary shredder 4, can continuously supply sludge entering the hopper 2 in the direction of arrow 6, to a first stage 8 for heating the sludge; a second stage 10 to further heat and to dry the sludge received from the first stage 8 by way of a serially connected rotary transfer lock 12 and a shredder 14; and a cyclonic stage 18 for deodorizing the dry particulate product from the second stage 10 received by way of a venturi 16 located at the input of a cyclonic stage 18.

The design of the hopper 2 and its rotary shredder 4 will be well known to those of skill in the appropriate art.

The first stage comprises a tubular housing 20, about 2 feet in diameter and about 30 feet long, concentrically surrounding a hollow shaft 22, about 6 inches in diameter, extending through the length of the tubular housing 20 and beyond the ends thereof by way of seals and bearings 24 for connection to a motor 26 capable of rotating the shaft 22 within the housing 20 at from about 10 to about 50 r.p.m. The hollow shaft 22 is connected at one end to receive high pressure non-turbulent steam at about 300° F. or more. The steam is exhausted at the other end of the shaft 22 after passage therethrough. The housing 20 is surrounded by two serially disposed insulated heat jackets 28 to insulate and heat the housing substantially throughout its length. To provide a source of heat to the heat jackets 28, steam inlets and outlets 30 are provided. As with the shaft 22 the steam for the jackets 28 is supplied as a high pressure non-turbulent steam at about 300° F.

Figure 6:
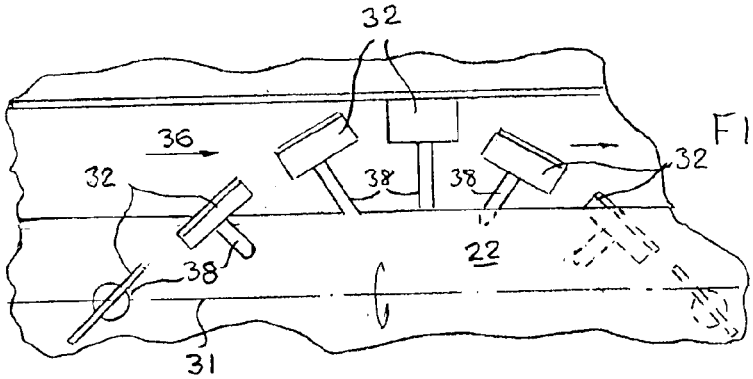
FIG. 6 illustrates a helical arrangement of the paddles of FIGS. 2 and 3.

The shaft 22 supports a plurality of helically inclined, relative to the axis 31 of the shaft 22 and housing 20, paddles 32 (two only being shown in FIG. 1). Sixteen or more such paddles 32 may be evenly spaced along the shaft 22 and these may be dispersed in a straight line parallel to the axis 31 of the shaft 22 or in a helical array as shown in FIG. 6.

Figure 2:
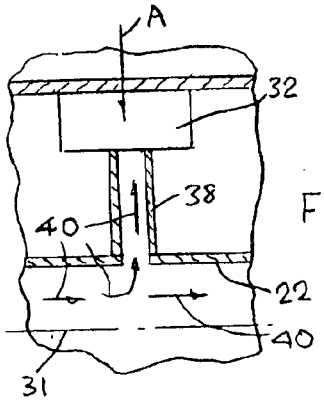
FIGS. 2 and 3 are fragmentary diagrammatic views of a helical paddle in a first stage of the apparatus of FIG. 1, FIG. 3 being a view in the direction of arrow A in FIG. 2.
Figure 3:
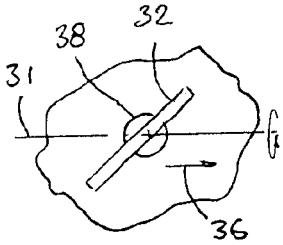

Each paddle 32 (see FIGS. 2 and 3) is inclined relative to the axis 31 to convey the sludge, entering the housing 20 from the hopper 2, toward the outlet end 34 in the direction of arrow 36 as the shaft 22 is rotated in the manner of an auger or screw conveyor. The outer end of each paddle 32 is shaped to be in close proximity or contact with the housing 20 throughout its axial length in order to scrape, from the housing, any sludge adhering to the inside of the housing. Each paddle 32 is supported on the shaft 22 by a tube 38 the interior of which is connected to the interior of the hollow shaft 22 whereby steam passing through the shaft may enter and heat the tube (see arrows 40 in FIG. 2).

Figure 4:
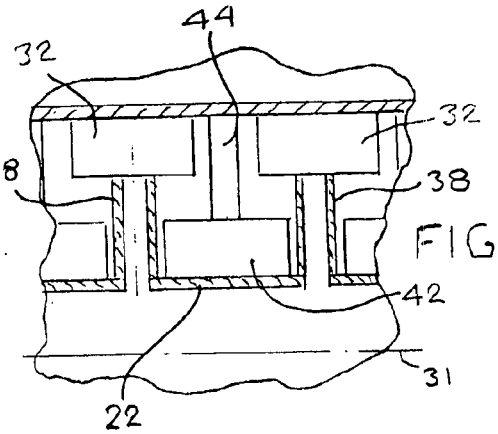
FIG. 4 is variation of the arrangement of FIGS. 2 and 3 in which shaft scraping paddles are provided.

As seen in FIG. 4, shaft scraping paddles 42 may be placed between adjacent pairs of the shaft mounted paddles 32 to scrape from the shaft 22 any sludge adhering to the shaft 22. These shaft scraping paddles 42 are usually parallel to the axis 31 and do not play a part in the conveyance of the sludge through the housing. However, the shaft scraping paddles 42 could be helically inclined so as not to hinder helical motion of the sludge along the housing. In this latter case the shaft scraping paddle inner ends are shaped to closely cooperate with the shaft throughout their axial length. The scraping paddles 42 are supported by tubes or rods 44 attached to the housing 20.

The temperature of the sludge is at least 200° F. at the outlet end 34 as determined by its rate of conveyance through the first stage 8 and the heating provided by the steam heated jackets 28 and shaft 22 during this conveyance.

The entire housing 20 and heat jackets 28 are insulated to prevent loss of heat from the housing 20. It should be noted that the heating of the sludge, in the first stage 8, takes place substantially at ambient pressure.

If required the housing 20 and shaft 22 may be constructed of serially interconnected parts and also, if required, two or more first stages 8 may be serially arranged before the heated sludge exits to the transfer lock 12.

Figure 8:
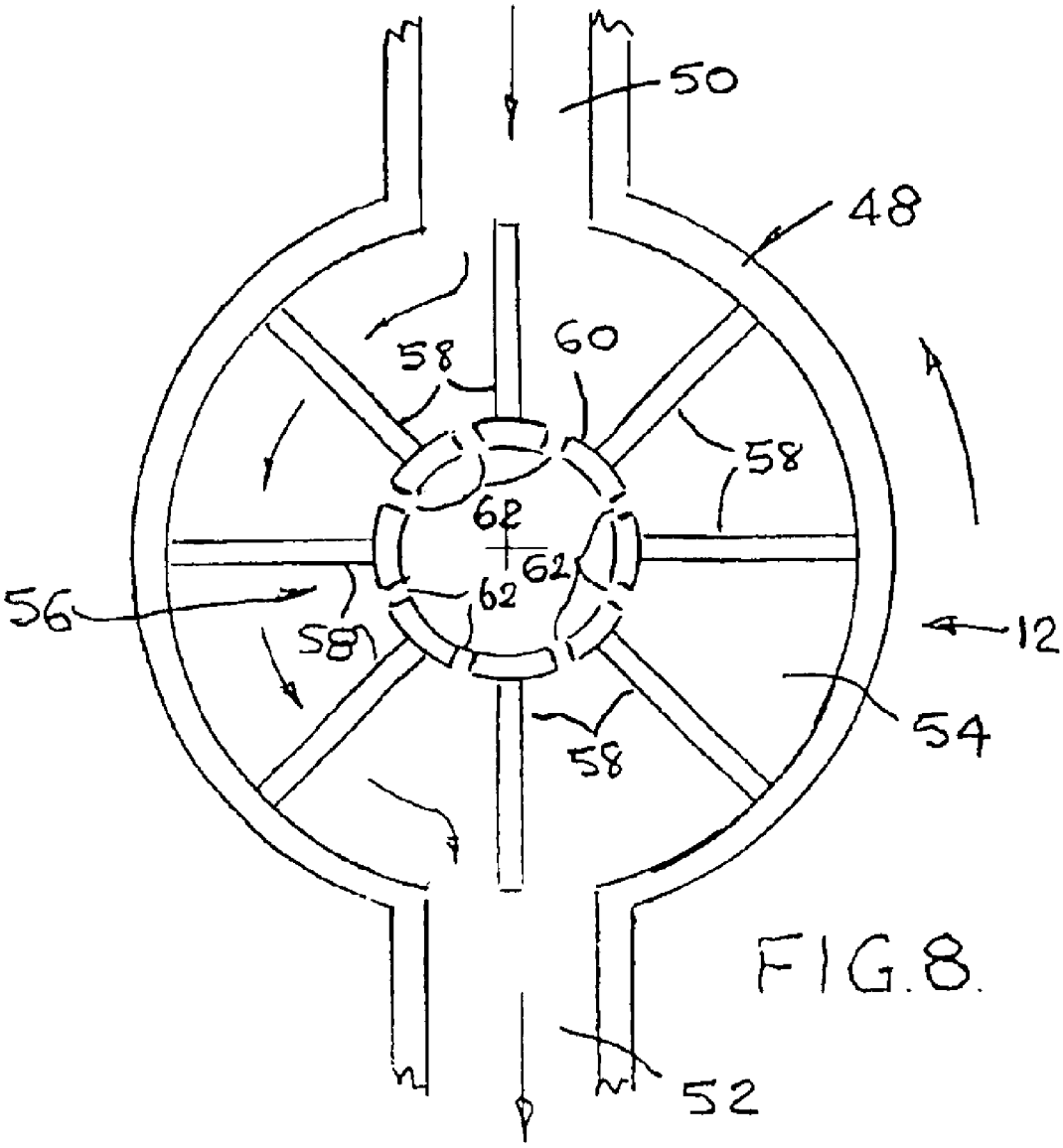
FIG. 8 is a diagrammatic representation of a transfer lock disposed between the first and second stages of the apparatus of FIG. 1.

The transfer lock 12 is a rotary device somewhat akin to a revolving door. The transfer lock 12 comprises a housing 48 defining an inlet 50, connected to the outlet end 34 of the first stage, and an outlet 52, to supply the heated sludge to the second stage 10 by way of the shredder 14, with a cylindrical portion 54 therebetween. The cylindrical portion 54 is closed at its ends. Housed in the portion 54 is a finned rotor 56 coaxial with cylindrical portion 54 comprising at least three, preferably six or eight, fins 58 mounted on a hollow shaft 60 with their radially outer ends contacting or in very close proximity to the cylindrical portion 54 and their axial ends contacting or in very close proximity to the closed ends of the cylindrical portion so that the path from the inlet 50 to the outlet 52 is always closed by at least two of the fins 58 to prevent loss of the partial vacuum from the second stage 10 while passing the heated sludge to the outlet 32. The hollow shaft is sealed and supported in the ends of the cylindrical housing. The finned rotor 56 (shown in greater detail in FIG. 8) is driven by a motor 46 at a rate of rotation to provide desired metering of the heated sludge from the outlet end 34 of the first stage 8 to the evacuated environment of the second stage 10.

Air is supplied through the hollow shaft 60 to openings 62 for onward passage into the heated sludge to prevent clogging. If the air is hot it will further heat the sludge, or at least maintain its temperature, so that heated sludge enters the second stage 10 at about 200° F. or more.

The heated sludge passes from the outlet 52 to a small shredder 14 driven by a shredder motor 66. The shredder 14 is sealed to prevent loss of vacuum from the second stage 20 and has a multi-bladed rotor driven at between about 200 and about 2000 r.p.m. to break the heated sludge into small pieces and particles. The small pieces and particulate material so formed is fed into the input end of the second stage 10 as shown by arrow 68.

Figure 5:
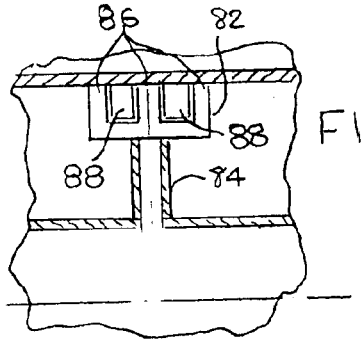
FIG. 5 is a diagrammatic sectional view of a tined paddle in a second stage of the apparatus of FIG. 1.
Figure 7:
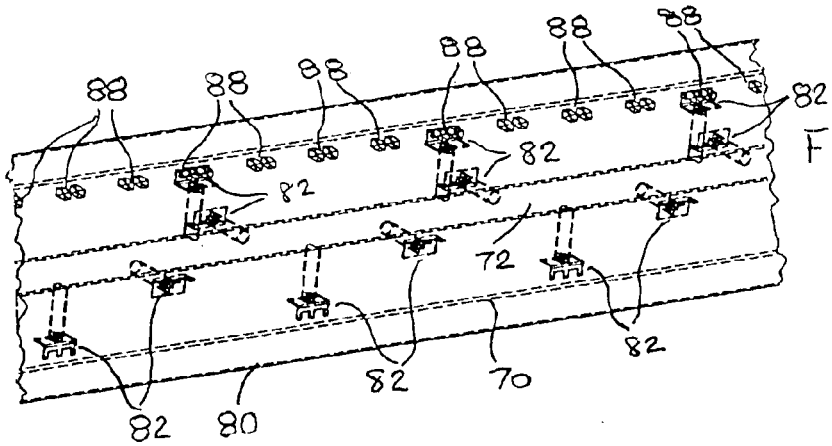
FIG. 7 illustrates a helical arrangement of the tined paddles of FIG. 5.

The second stage 10 comprises a cylindrical housing 70 coaxial with a hollow rotatable shaft 72 supported in bearings 74 and sealed by seals 76, at the ends of the housing 70, for rotation at about 10 to about 50 r.p.m. by a motor 78. The housing has a diameter of about two feet, a length of about 15 feet and is surrounded by an insulated heat jacket 80. The hollow shaft 72 has an outside diameter of from about six inches to about one foot. Mounted on the shaft 72 are a plurality of tined projections 82 (see FIGS. 1, 5 and 7) distributed along and around the shaft 72 (FIG. 7) and supported on the shaft by tubular supports 84 the interiors of which are open to the interior of the shaft 72 whereby non-turbulent high pressure steam, at about 300° F., passing through the shaft 72 can enter and heat the tubular supports and tined projections 82.

Each tined projection 82 has three equi-spaced tines 86 terminating at or closely proximate the interior cylindrical surface of the housing 70. Affixed to the housing are blocks 88 sized to closely pass between the tines 86 as the tined projections 82 are rotated by the shaft 72 thereby to remove any particulate material held between the tines.

The heat jacket 80 has connections 90 for the admission and exhaust of high pressure non-turbulent steam at about 300° F. whereby the steam passes through the heat jacket 80 to heat the housing 70 and the particulate material therein.

The housing 70 is evacuated to about 20 inches Hg. below ambient pressure by a vacuum pump 106 attached to a cyclone 18 which receives particulate material dried in the second stage 10 by way of a duct 94 and a venturi 16. The pressure in the housing may be adjusted by controlling (bleeding) air into air inlet 98 at the inlet end of the housing 70.

The venturi 16 may have an air inlet 100 for pressurized air to increase acceleration of the dried particulate material into the cyclone 18 substantially tangentially along the cyclone's inner surface.

The cyclone 18 has a cylindrical upper body connected to an inverted cone which decreases in diameter to an outlet controlled by a rotary particle lock 102 which functions in similar manner to the transfer lock 12 to remove the particulate material from the cyclone 18. This lock 102 is driven by motor 104.

The accelerated particulate material entering the cyclone is subjected to centrifugal force due to its motion around the interior of the cyclone and to the force of gravity. As a result the particulate material follows a helical path to the particle lock 102.

The second stage 10 and cyclone are evacuated by the vacuum pump 106 connected to an outlet 108 at the top of the cyclone 18. A baffle 110 ensures that the particulate material is not drawn into the vacuum pump 106.

The forces applied to the particulate material in the cyclone serve to substantially destroy odors and to destroy any pathogens remaining in the particulate material.

Although preferably horizontal the first and second stages may be inclined downwardly from their inlets to their outlets in order to assist in conveyance of the sludge/particulate material therethrough.

It will be appreciated that while the use of steam for heating has been described above, other sources of heat, e.g. hot air, electrical elements, solar energy, geothermal energy, could be used. The source for heating the various components of the invention may also be combined into a single source with an appropriate distribution system and/or different types of heat source could be used in different components or combinations of components.

Similarly, some or all of the motors could be replaced by a single motor with appropriate transmission arrangements to drive associated components.

It will also be appreciated that the vacuum pump 106 may have an outlet connected to a condenser to condense water vapor or steam removed from the sludge and removed through the vacuum pump 106.

| Reference numbers | |
|---|---|
| 2 | supply hopper |
| 4 | rotary shredder |
| 6 | arrow |
| 8 | first stage |
| 10 | second stage |
| 12 | transfer lock |
| 14 | shredder |
| 16 | venturi |
| 18 | cyclone |
| 20 | cylindrical housing |
| 22 | hollow shaft |
| 24 | seals and bearings |
| 26 | motor |
| 28 | heat jackets |
| 30 | steam inlets and outlets |
| 31 | axis |
| 32 | paddles |
| 34 | outlet end |
| 36 | arrow |
| 38 | tube |
| 40 | arrows |
| 42 | shaft scraping paddles |
| 44 | tubes or rods |
| 46 | transfer lock motor |
| 48 | lock housing |
| 50 | inlet |
| 52 | outlet |
| 54 | cylindrical portion |
| 56 | finned rotor |
| 58 | fins |
| 60 | hollow shaft lock |
| 62 | openings |
| 66 | shredder motor |
| 68 | arrow |
| 70 | housing |
| 72 | shaft |
| 74 | bearings |
| 76 | seals |
| 78 | motor |
| 80 | heat jacket |
| 82 | tined projection |
| 84 | tubular supports |
| 86 | tines |
| 88 | blocks |
| 90 | connections |
| 94 | duct |
| 98 | air inlet |
| 100 | air inlet |
| 102 | particle lock |
| 104 | motor |
| 106 | vacuum pump |
| 108 | outlet |
| 110 | baffle |

I claim:

1. A material drying apparatus for continuous operation to substantially evaporate the liquid content of a sludge, the apparatus comprising:

a first stage operating at ambient pressure for heating the sludge;

a second stage operating with partial vacuum for receiving heated sludge from the first stage for further heating and for drying the sludge by evaporation of substantially all liquid therefrom to leave a dry particulate material;

a cyclonic stage operating with a partial vacuum for applying sufficient centrifugal force to the dry particulate material to render this material benign;

a cylindrical housing in the first stage defining a longitudinal axis, a hollow shaft coaxial with the housing and extending entirely through the housing, and conveyor paddles mounted on the hollow shaft and helically inclined relative to the axis to convey, upon rotation of the hollow shaft, sludge from an input end of the cylindrical housing to an outlet end thereof while being heated; and wherein the paddles are mounted on the hollow shaft by tubes the interiors of which are open to the interior of the hollow shaft whereby steam introduced into the hollow shaft will enter the tubes to provide a heat source for the sludge.

2. The apparatus of claim 1 comprising a source of pressurized air combined with a venturi nozzle for accelerating the dry particulate material prior to entry into the cyclonic stage.

3. The apparatus of claim 2 comprising a vacuum system to provide a partial vacuum in the second stage and the cyclonic stage, and to remove evaporated liquid from the apparatus.

4. The apparatus of claim 1 comprising steam heated jackets for heating the first and second stages.

5. The apparatus of claim 1, wherein the paddles terminate at their radially outer ends sufficiently proximate the cylindrical housing to scrape sludge from the housing during rotation of the paddles about the axis by the hollow shaft.

6. The apparatus of claim 1 wherein the second stage comprises a cylindrical housing defining a longitudinal axis, a hollow shaft coaxial with said housing and a plurality of tined projections mounted on the shaft for rotation with the shaft to agitate particles and breakup small places of the sludge entering the second stage.

7. The apparatus of claim 6 wherein the tined projections terminate closely adjacent the housing with each projection having a plurality of tines and with the housing supporting blocks which cooperate with the tines upon rotation thereof to remove material from between the tines.

8. The apparatus of claim 6 comprising a steam heatable jacket surrounding the cylindrical housing to heat the sludge in the second stage.

9. The apparatus of claim 8 wherein the tined projections are mounted on the hollow shaft by tubes the interiors of which are open to the interior of the hollow shaft to receive steam passed through the hollow shaft to provide additional heating of the sludge.

10. The apparatus of claim 1 wherein dried particulate material from the second stage is drawn into a cyclone by a vacuum pump connected to the cyclone to provide the partial vacuum in the cyclone and second stage, the material being drawn into the cyclone by way of a venturi to accelerate the particles for entry tangentially into the cyclone whereby centrifugal force generated by passage of the dried particles in the cyclone destroys any pathogens remaining in the dried particles.

11. The apparatus of claim 10 comprising a rotary transfer lock located to provide an outlet for particles from the cyclone and to substantially prevent loss of the partial vacuum from the second stage and the cyclone.

12. The apparatus of claim 1, wherein shaft scraping paddles are mounted on the cylindrical housing between adjacent pairs of the conveyor paddles.

13. The apparatus of claim 1 wherein the sludge is heated in the first stage to at least 200° F., the temperature of the heated sludge entering the second stage is at least 200° F. and the partial vacuum in the second stage in the cyclone is about 20 inches of mercury below atmospheric pressure.

14. A material drying apparatus for continuous operation to substantially evaporate the liquid content of a sludge, the apparatus comprising:

a first stage operating at ambient pressure for heating the sludge;

a second stage operating with partial vacuum for receiving heated sludge from the first stage for further heating and for drying the sludge by evaporation of substantially all liquid therefrom to leave a dry particulate material;

a cyclonic stage operating with a partial vacuum for applying sufficient centrifugal force to the dry particulate material to render this material benign; and a rotary transfer lock disposed between an outlet for the heated sludge from the first stage and an inlet for the heated sludge into the second stage, the transfer lock comprising a cylindrical chamber closed at its ends and housing a finned rotor having a plurality of fins cooperating with the cylindrical chamber to substantially prevent loss of the partial vacuum from the second stage while, upon rotation of the finned rotor, the heated sludge from the first stage is metered through the transfer lock for onward transmission to the second stage.

15. The apparatus of claim 14 wherein the finned rotor is hollow and is provided with openings to allow hot air introduced into the rotor to pass into the heated sludge being metered through the transfer lock in order to one of further heat and maintain heat of the sludge.

16. The apparatus of claim 14 comprising a shredder disposed between the rotary transfer lock and the inlet for the heated sludge into the second stage, the shredder serving to break the heated sludge into small pieces and particles.

17. A material drying apparatus for continuous operation to substantially evaporate the liquid content of a sludge, the apparatus comprising:

a first stage operating at ambient pressure for heating the sludge;

a second stage operating with partial vacuum for receiving heated sludge from the first stage for further heating and for drying the sludge by evaporation of substantially all liquid therefrom to leave a dry particulate material;

a cyclonic stage operating with a partial vacuum for applying sufficient centrifugal force to the dry particulate material to render this material benign; and a rotary transfer lock disposed between an outlet for the heated sludge from the first stage and an inlet for the heated sludge into the second stage.

* * * * *